US005418104A

United States Patent [19]

Lawson

[11] Patent Number: 5,418,104

[45] Date of Patent: May 23, 1995

[54] TONER FOR ELECTROSTATOGRAPHY

[75] Inventor: Terence M. Lawson, Aldgate, Australia

[73] Assignee: MAN Roland Druckmaschinen AG, Offenbach am Main, Germany

[21] Appl. No.: 905,168

[22] Filed: Jun. 24, 1992

Related U.S. Application Data

[63] Continuation of Ser. No. 669,510, Mar. 14, 1991, abandoned.

[30] Foreign Application Priority Data

Apr. 3, 1990 [AU] Australia ..... PJ9452

[51] Int. Cl.[6] ..... G03G 9/00

[52] U.S. Cl. ..... 430/110; 430/114; 430/119; 430/137; 428/364; 428/407

[58] Field of Search ..... 430/106, 114, 119, 137, 430/110; 428/364, 407

[56] References Cited

U.S. PATENT DOCUMENTS

| | | | |
|---|---|---|---|
| 4,021,586 | 5/1977 | Matkan . | |
| 4,241,159 | 12/1980 | Priem et al. | 430/114 |
| 4,740,444 | 4/1988 | Trout | 430/137 |
| 4,797,342 | 1/1989 | Croucher et al. . | |
| 4,855,207 | 8/1989 | Tsubuko et al. | 430/114 X |
| 4,923,778 | 5/1990 | Blair et al. | 430/114 X |
| 5,191,834 | 3/1993 | Fuhrmann et al. | 101/130 |
| 5,213,931 | 5/1993 | Staples et al. | 430/102 |

FOREIGN PATENT DOCUMENTS

| | | |
|---|---|---|
| 0240003 | 10/1987 | European Pat. Off. . |
| 2313547 | 10/1973 | Germany . |
| 3247925 | 6/1984 | Germany . |

OTHER PUBLICATIONS

Chemical Abstracts, vol. 98, No. 6, 7. Feb. 1983, p. 600, col. 1 Czech CS 199.799.

*Primary Examiner*—S. Rosasco

*Attorney, Agent, or Firm*—Frishauf, Holtz, Goodman & Woodward

[57] ABSTRACT

To provide for adhesion of toner particles on a latent image on a ferroelectric material substrate, the toner is so constituted that, upon being transported in close proximity to the ferroelectric substrate, the toner will shape itself into a wave to form a hydraulic meniscus, so that the toner will be adhered by hydraulic meniscus toning. The toner must have low electrical conductivity and is so formulated that particles are kept as discrete entities without interconnection to each other by mechanical or electrical binding. The toner materials can be acrylics, acrylic copolymers, polyethylene, polyethylene vinylacetate copolymers; suitable solvents are aliphatic solvent soluble rosin, rosin esters, rosin ester derivatives, phthalate esters and abietic acid esters; the thermoplastic polymer should be soluble in the dispersant between about 90° C. to 100° C., but insoluble at ambient temperature, and the plasticizer is soluble in the dispersant at both elevated and ambient temperature.

16 Claims, No Drawings

TONER FOR ELECTROSTATOGRAPHY

This application is a Continuation of application Ser. No. 07/669,510, filed Mar. 14, 1991, now abandoned.

FIELD OF INVENTION

This invention relates to electrostatography, and more particularly to a method of applying a toner to an electrostatic image and to toner compositions adapted for contact toning in accordance with a commanded image of electrostatic latent images of relatively low surface charge of the persistent internal polarisation type.

BACKGROUND

It is known that latent electrostatic images can be developed with toner particles dispersed in insulating or non-polar liquids. Such toner particles normally comprise colouring matter such as pigments which have been ground with or otherwise combined with dispersing resins or varnishes or the like. Such toner particles usually have combined therewith fixing materials which are commonly but not necessarily thermoplastic polymeric materials. Additionally polarity control or charge directing agents are usually included to control the polarity and charge mass ratio of the toner particles. Such dispersed materials are known as liquid toners or liquid developers.

Initially liquid developers were used commercially in office copiers of the non-transfer type, that is in which the electrostatic latent image on a zinc oxide/resin binder photoconductive coating on a paper sheet was developed thereon and fixed thereto. The toner particles were not required to be transferable to other receptor surfaces. Subsequently when it was desired to transfer such toner deposits to a receptor surface using electrostatic transfer techniques problems were found relating to transfer efficiency, image shift, bleed and loss of resolution, well known to those skilled in the art.

The earliest liquid toner compositions known to us to have been formulated with a view to overcoming transfer problems previously referred to are as revealed by Wright in U.S. Pat. No. 3,419,411, now expired. In this disclosure so called lattice forming materials were included in the toner compositions to inhibit unwanted shift of colouring matter during image transfer. Such lattice forming materials were considered to form a fibrous matrix within the toner deposit whereby the colouring matter was restrained in place within such image deposit and enabled to be transferred truly without lateral shift to a receiving sheet using conventional electrostatic transfer techniques. Such lattice forming materials were also considered to maintain the image deposit in a condition amenable to transfer whereby transfer efficiencies in excess of ninety per cent were readily obtained. Further as dispersant liquid contained within the image deposit was removed after transfer such image deposit became mechanically fixed to the receptor sheet and did not back transfer if subsequent imaged deposits were transferred thereon. The lattice forming materials disclosed were rubber modified polystyrene, paraffin wax and ethyl cellulose. Ethyl cellulose was used in conjunction with a thermoplastic binder material such as polyisobutyl methacrylate, whereas paraffin wax was used in conjunction with a polymerised linseed oil/calcium resinate varnish.

Landa in U.S. Patent No 4,842,974 particularly argues against the Wright disclosure with regards to the lattice forming properties of ethyl cellulose or rubber modified polystyrene. His argument against paraffin wax is less specific and in fact admits that control of the KB value of the non-polar liquid dispersant affects the absolute resolution capabilities of the liquid toner, which could well be an admission of the validity of the Wright argument. However Landa describes and illustrates plasticising a thermoplastic polymer and a pigment with a non-polar liquid at an elevated temperature, cooling to form a sponge and further grinding such sponge with additional non-polar liquid to pull the particles apart and form fibres thereon and extending therefrom, which could be described as a mechanical equivalent to the lattice of Wright.

Mitchell, in U.S. Patent No 4,631,244 also discloses the formulation of liquid toners containing resinous "fibres" which term is stated to mean pigmented toner particles formed until fibres, tendrils, tentacles, threadlets, fibrils, ligaments, hairs, bristles or the like. Thermoplastic polymers are disclosed, specifically acrylic polymers and copolymers and ethylene vinyl acetate co-polymers. Temperature controlled attritor milling is used to obtain toner particles of the required particle size range. In addition to the non-polar dispersant liquid, other liquids of higher KB value are included during the grinding step, which is also in part anticipated by Wright. Control agents are also included, but generally other aids to dispersion such as oils or varnishes are omitted, as also are lattice or fibre forming materials such as waxes.

The present invention uses many of the materials of the prior art and in addition uses known milling methods for toner preparation, but in view of the prior art the resultant liquid toners exhibit some surprising features as will become apparent in the following.

THE INVENTION

It is an object to deposit toner on a latent image on a ferroelectric material by imaging the latent image by a development process in which a physical wave or meniscus is generated in a liquid dispersion of the toner, and to provide a toner, and method of making it, suitable in this method.

In the specification and claims, the term "hydraulic meniscus toning" is used; this term means that a physical wave or convex meniscus is formed by the toner when contacting the ferroelectric material on which a latent image is stored, which is to be developed.

Briefly, the toner in accordance with the present invention has low electrical conductivity and is so formulated that particles are kept as discrete entities, without interconnection to each other by mechanical or electrical binding.

The toner of the present invention has general application to electrostatography, although it is particularly useful to image a latent image on a ferroelectric material.

In the present invention this combination of properties is achieved by preparing the toner using electrically insulative polymers which are substantially insoluble in the toner carrier liquid or dispersant at ambient room temperatures, in combination with a polymer modifier which prevents the formation of polymer fibres.

It is a feature of these toners that the electrically insulative polymers are usually thermoplastic and can be solubilised in the dispersant at elevated temperatures and return to their original solid form upon cooling of the heated solution. The pigment or other matter used for colouring the toner particles is included in the heated solution by various grinding procedures, the most controllable being those wherein the grinding vessel is surrounded by a jacket through which either heating or cooling fluids can be circulated. Such equipment can be Pearl Mills, sand mills, ball mills and attritors. Preferred equipment is that wherein the grinding speed can be altered, and materials can be added conveniently in a sequential manner if so desired. Attritors are such preferred equipment.

It has been found that if pigments are dispersed in polymers which are solubilised at elevated temperatures, upon cooling with continued grinding the polymer precipitates, encapsulating or enveloping the pigment particles in a polymer sheath. This effectively isolates the pigment particles, thus maintaining a usefully low electrical conductivity in the toner dispersion. However as disclosed by Landa such a procedure produces an undesirable mechanical effect, manifest as an interconnection of particles by a network of polymer fibres. This effect can be reduced substantially and even eliminated to enable the pigmented particles to act as separate entities rather than bound together in a lattice structure. It has been found that when this discreteness is attained meniscus toning becomes possible.

In order to reduce or eliminate particle networking via polymer bridges or fibres a suitable polymer modifier is included in the dispersant. This modifier is both chemically compatible with the polymer at ambient and elevated temperatures, and completely soluble in the dispersant liquid at ambient and elevated temperatures. This modifier, or more correctly plasticiser, alters the physical nature of the polymer such that it enhances its solubility in the dispersant at elevated temperatures, and upon cooling increases the flexibility of the polymer such that shredding or tearing of polymer, responsible for the forming of fibres, is not facilitated. The particles formed by grinding the modified precipitated polymer as cooling proceeds are caused to have a smooth surface, free from any extensible projections capable of interlocking with nearby particles.

The dispersant liquid for such toner preparation must have properties which enable it to be acceptable commercially and yet function in the manner desired. Aliphatic hydrocarbons of high boiling point are particularly applicable. Preferred liquids are those manufactured by Exxon Corporation under the trade name of Isopar, in particular the grades Isopar L, (Boiling Range 190–206 deg C.), Isopar M (Boiling Range 207–254 deg C.), and Isopar V (Boiling Range 273–310 deg C.). Also in the Exxon range of solvents usable in this application are the Norpar range and some of the dearomatized solvents known as Exxsol D.

The primary polymer in this toner system must be soluble in the chosen dispersant at elevated temperatures, yet be substantially insoluble at room temperatures. Of polymers available, acrylics and their copolymers, polyethylene, and polyethylene vinylacetate copolymers are particularly suitable. Preferred materials are the Elvax range of ethylene vinyl acetate copolymers supplied by Union Carbide Australia Ltd., and the Acryloid range of acrylates supplied by Rohm and Haas Australia Ltd. Also applicable are certain of the Neocryl range of acrylates supplied by ICI Australia Operations Pty Ltd.

The modifier for the polymer must be compatible with the polymer at temperatures encountered during toner preparation, and soluble in the dispersant under similar conditions. Such material will normally be specific to the polymer selected, but in general it has been found that aliphatic solvent soluble rosin, rosin esters and their derivatives, phthalate esters and abietic esters function well in this context.

The pigments used can be any of the organic or inorganic pigments normally found in the printing ink or paint industries.

As an additional ingredient, charge directors or charge augmenters can be included in the formulation. These are well known and for positively charged toners most commonly used compounds are metallic soaps, of which zirconium octoate, manganese naphthenate and aluminium stearate are typical examples.

Thus the present invention comprises a toner for hydraulic meniscus toning in electrostatography and for imaging a latent image on ferroelectric material consisting essentially of discrete toner particles in suspension in a dispersant of low electrical conductivity, such discrete toner particles comprising pigment particles surrounded by a layer of electrically insulative thermoplastic polymer and a plasticiser therefor. In accordance with a feature of the invention, the electrically insulative thermoplastic polymer 9 is selected from the group comprising acrylics, acrylic copolymer, polyethylene, and polyethylene vinylacetate copolymers, and further characterised by said plasticisers being selected from the group aliphatic solvent soluble rosin, rosin esters, rosin ester derivatives, phthalate esters and abietic acid esters, further characterised by said electrically insulative thermoplastic polymer being soluble in said dispersant of low electrical conductivity at elevated temperature of the order of 90° C. to 100° C. and insoluble at ambient temperature, and said plasticiser being soluble in said dispersant of low electrical conductivity at both elevated and ambient temperatures.

DETAILED DESCRIPTION

The following examples will serve to illustrate more fully the principles of the present invention. However such examples should be read in the illustrative sense only and should not be considered to limit the scope of the invention to the materials listed therein.

EXAMPLES 1

The following ingredients are charged into a heated attritor:

| | |
|---|---|
| Elvax 210 | 10 grms |
| Pentalyn H | 15 grms |
| 6% Zirconium octate | 10 grms |
| Isopar L | 250 grms |

The above ingredients are heated to 90 deg C. with stirring at slow speed to effect solution of the solid materials in the solvent, at which time is added:

Irgalite blue LGLD 15 grms

Heating is maintained at a level to keep the mixture at 90–100 deg C., and the stirring speed is increased to a point at which milling occurs. This speed is dependent on the size of the equipment used. Milling is continued for a 2 hour period at this elevated temperature, at which time the heating is terminated, and as milling continues the attritor and contents are allowed to cool to room temperature. For a mill of approximately 250 ml capacity this stage of milling will be of about 3 hours duration, but may be continued for further time if so desired.

The thus prepared toner, which diluted to a working strength of 5 to 100 ml concentrate per litre of dispersant, exhibits hydraulic meniscus toning when used in a suitable toning equipment, and when examined by a Scanning Electron Microscope is found to consist of smooth discrete particles having a minimum of bridging between the particles. Fibres or tendrils are not present.

EXAMPLE 2

The following formulation when prepared as disclosed in Example 1 produces a blue toner which exhibits the desired toning properties and whose constituent particles do not have fibrous extensions:

| | |
|---|---|
| Irgalite blue LGLD | 15 grms |
| Acryloid B67 | 10 grms |
| Corflex 400 | 15 grms |
| Aluminium stearate | 2 grms |
| Exxsol D60 | 250 grms |

EXAMPLES 3

The following formulation when prepared as disclosed in Example 1 produces a red toner which exhibits the desired toning properties and whose constituent particles do not have fibrous extensions:

| | |
|---|---|
| Hostaperm pink E | 15 grms |
| Elvax 210 | 10 grms |
| Abalyn | 20 grms |
| 4% manganese naphthenate | 5 grms |
| Norpar 12 | 250 grms |

The following describes materials disclosed in the examples.

Irgalite blue LGLD is C.I. Pigment blue 15:3 supplied by Ciba-Geigy Australia Ltd.

Hostaperm pink E is C.I. Pigment red 122 supplied by Hoechst Australia Ltd.

Elvax 210 is an ethylene vinyl acetate copolymer, melt index 355–465, vinylacetate content 27–29%, supplied by Union Carbide Australia Ltd.

Acryloid B67 is an isobutyl methacrylate polymer, softening point 50 deg C., supplied by Rohm and Haas Australia Pty Ltd.

Pentalyn H is a pentaerythritol ester of rosin, acid number 7–16, melting range 102–110 deg C., supplied by A. C. Hatrick Chemicals Pty Ltd.

Corflex 400 is dibutyl phthalate, supplied by CSR Australia Ltd.

Zirconium octoate contains 6% metal, supplied as a solution in white spirit by A. C. Hatrick Chemicals Pty Ltd.

Manganese naphthenate contains 4% metal, supplied as a solution in White Spirit by A. C. Hatrick Chemicals Pty Ltd.

Aluminium stearate, melting point 156 deg C., supplied by Harcross Australia Pty Ltd.

Isopar L is an isoparaffinic hydrocarbon, boiling range 190–206 deg C., supplied by Exxon Chemical Australia Pty Ltd.

Norpar 12 is a normal paraffinic hydrocarbon, boiling range 188–217 deg C., supplied by Exxon Chemical Australia Pty Ltd.

Exxsol D60 is a dearomatised hydrocarbon, boiling range 182–215 deg C., supplied by Exxon Chemical Australia Pty Ltd.

I claim:

1. A toner for developing a latent image on a body of ferroelectric material, carrying the latent image thereon in the form of polarized discrete regions, by contact with the ferroelectric material in the form of a physical wave or meniscus for hydraulic meniscus toning of the latent image on the ferroelectric material, wherein the toner has low electrical conductivity and comprises toner material comprising essentially discrete toner particles in suspension within a dispersant of low electrical conductivity to inhibit electrical binding of the toner particles, the discrete toner particles comprise pigment particles surrounded by a layer of electrically insulative thermoplastic polymer and a plasticizer therefor, the toner particles are essentially discrete in form and devoid of surface protuberances in the form of fibers, tendrils, fibrils, hairs or bristles, in order to inhibit mechanical binding between particles; and wherein said electrically insulating thermoplastic polymer of the toner material is selected from the group consisting of acrylics, acrylic copolymers, polyethylene, and polyethylene vinylacetate copolymers.

2. The toner of claim 1, wherein the plasticizers in the toner material are selected from the group consisting of aliphatic solvent soluble rosin, rosin esters, rosin ester derivatives, phthalate esters and abietic acid esters.

3. The toner of claim 1, wherein the electrically insulative thermoplastic polymer is soluble in said dispersant of low electrical conductivity at elevated temperature in the order of 90° C. to 100° C. and insoluble at ambient temperature; and wherein said plasticizer is soluble in said dispersant of low electrical conductivity at both elevated and ambient temperature.

4. The toner of claim 1, wherein the toner further includes a charge director selected from the group consisting of zirconium octoate, aluminum stearate and manganese naphtenate.

5. The toner of claim 1, wherein the electrically insulative thermoplastic polymer and said plasticizer, together with said low electrical conductivity solvent are heated to an elevated temperature of 90° C. with stirring at slow speed in an attritor to effect solution of the solid materials in the solvent, followed by addition of said pigment particles and increase of the stirring speed to a point at which milling occurs, milled for a period at this elevated temperature, followed by cooling of the attritor and contents thereof while continuing milling to effect coating of said pigment particles with a plasticized layer of said electrically insulative thermoplastic polymer.

6. The toner of claim 5, wherein the toner is diluted to a working strength of 5 to 100 ml of concentrate per liter of dispersant.

7. The combination of a carrier of ferroelectric material with a latent image thereon defined by polarized discrete regions on the carrier with toner material adhered to said ferroelectric material in accordance with the latent image thereon, wherein the toner material is of low electrical conductivity and comprises essentially discrete toner particles in suspension within a dispersant of low electrical conductivity to inhibit electrical binding of the toner particles, the discrete toner particles comprise pigment particles surrounded by a layer of electrically insulating thermoplastic polymer and a plasticizer therefor, the toner particles are essentially discrete in form and devoid of surface protruberances in the form of fibers, tendrils, fibrils, hairs or bristles, in order to inhibit mechanical binding between particles; and wherein said electrically insulating thermoplastic polymer of the toner material is selected from the group consisting of acrylics, acrylic copolymers, polyethylene, and polyethylene vinylacetate copolymers.

8. The combination of claim 7, wherein the plasticizers in the toner material are selected from the group consisting of aliphatic solvent soluble rosin, rosin esters, rosin ester derivatives, phthalate esters and abietic acid esters.

9. The combination of claim 7, wherein the electrically insulating thermoplastic polymer is soluble in said dispersant of low electrical conductivity at elevated temperature in the order of 90° C. to 100° C. and insoluble at ambient temperature; and wherein said plasticizer is soluble in said dispersant of low electrical conductivity at both elevated and ambient temperature.

10. The combination of claim 7, wherein the toner further includes a charge director selected from the group essentially consisting of zirconium octoate, aluminum stearate and manganese naphthenate.

11. The combination of claim 7, wherein the electrically insulative thermoplastic polymer and said plasticizer, together with said low electrical conductivity solvent, are heated to an elevated temperature of 90° C. with stirring at slow speed in an attritor to effect solution of the solid materials in the solvent, followed by addition of said pigment particles and increase of the stirring speed to a point at which milling occurs, milled for a period at this elevated temperature, followed by cooling of the attritor and contents thereof while continuing milling to effect coating of said pigment particles with a plasticized layer of said electrically insulative thermoplastic polymer.

12. The combination of claim 11, wherein the toner is diluted to a working strength of 5 to 100 ml of concentrate per liter of dispersant.

13. A method of applying toner particles on a carrier of ferroelectric material, on which a latent image is retained in form of polarized discrete regions, said method comprising the steps of placing the ferroelectric material and a toner into close proximity, wherein said toner consists of toner material of low electrical conductivity, which consists of essentially discrete toner particles in suspension within a dispersant of low electrical conductivity to inhibit electrical binding of the toner particles, the discrete toner particles comprise pigment particles surrounded by a layer of electrically insulating thermoplastic polymer and a plasticizer therefor, the toner particles are essentially discrete in form and devoid of surface protruberances in the form of fibers, tendrils, fibrils, hairs or bristles, in order to inhibit mechanical binding between particles; and wherein said electrically insulating thermoplastic polymer of the toner material is selected from the group consisting of acrylics, acrylic copolymers, polyethylene, and polyethylene vinylacetate copolymers, said toner generating a physical wave or meniscus when placed in close proximity to said ferroelectric material by contacting said ferroelectric material, said discrete toner particles adhering to said ferroelectric material in accordance with the latent image defined by the polarized discrete regions.

14. The method of claim 13, wherein the toner further includes a charge director selected from the group essentially consisting of zirconium octoate, aluminum stearate and manganese naphthenate.

15. The method of claim 13, wherein said high resistivity thermoplastic polymer and said plasticizer, together with said low electrical conductivity solvent, are heated to an elevated temperature of 90° C. with stirring at slow speed in an attritor to effect solution of the solid materials in the solvent, followed by addition of said pigment particles and increase of the stirring speed to a point at which milling occurs, milling for a period at this elevated temperature, followed by cooling of the attritor and contents thereof while continuing milling to effect coating of said pigment particles with a plasticized layer of said electrically insulating thermoplastic polymer.

16. The method of claim 13, wherein said toner is diluted to a working strength of 5 to 100 ml of concentrate per liter of dispersant.

* * * * *